US006681889B2

(12) United States Patent
Collmer et al.

(10) Patent No.: US 6,681,889 B2
(45) Date of Patent: Jan. 27, 2004

(54) EXHAUST MUFFLER FOR A FUEL-OPERATED HEATING DEVICE

(75) Inventors: Andreas Collmer, Ostfildern (DE); Thomas Rose, Stuttgart (DE)

(73) Assignee: J. Eberspacher GmbH & Co., Esslingen (DE)

( * ) Notice: Subject to any disclaimer, the term of this patent is extended or adjusted under 35 U.S.C. 154(b) by 0 days.

(21) Appl. No.: 10/016,235

(22) Filed: Dec. 6, 2001

(65) Prior Publication Data

US 2002/0066619 A1 Jun. 6, 2002

(30) Foreign Application Priority Data

Dec. 6, 2000 (DE) ..... 100 60 522

(51) Int. Cl.[7] ..... F01N 1/02; F01N 1/10; F01N 1/00; F01N 1/24

(52) U.S. Cl. ..... 181/251; 181/252; 181/255; 181/256

(58) Field of Search ..... 181/247–257, 181/268

(56) References Cited

U.S. PATENT DOCUMENTS 3,340,957 A * 9/1967 Vautaw et al. ..... 181/268
4,574,913 A * 3/1986 Fukuda ..... 181/231
4,836,330 A * 6/1989 Harwood et al. ..... 181/282
5,036,585 A * 8/1991 Schweinfurth ..... 29/890.08
5,581,056 A * 12/1996 Bellgardt et al. ..... 181/282
5,602,368 A * 2/1997 Kaneso ..... 181/255
5,783,782 A * 7/1998 Sterrett et al. ..... 181/272
5,912,441 A * 6/1999 Worner ..... 181/282

* cited by examiner

*Primary Examiner*—Robert E. Nappi
*Assistant Examiner*—Patrick Miller

(57) ABSTRACT

An exhaust muffler for a fuel-operated heating device has upper and lower housing half shells, an exhaust gas through-duct and absorption and reflection chambers. The exhaust muffler is connectable to an exhaust pipe of the heating device. The exhaust gas through-duct has an inlet pipe of a single absorption chamber and a single following reflection chamber that are separated by a partially perforated partition, with double reversal of the exhaust gas flow, and an outlet pipe; the inlet pipe being perforated on the outer surface side, with an S-shaped curved section and a straight end section, and the outlet pipe being a straight outlet pipe, closed on the outer surface side, and the straight section of the inlet pipe runs parallel to, and at a spacing from, an inlet section of the outlet pipe.

23 Claims, 2 Drawing Sheets

EXHAUST MUFFLER FOR A FUEL-OPERATED HEATING DEVICE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to an exhaust muffler for a fuel-operated heating device, of half-shell construction with upper and lower housing half shells and also with an exhaust gas through-duct and absorption and reflection chambers, particularly for stationary heating devices or booster heaters for motor vehicles, in which the exhaust muffler can be connected to an exhaust pipe of the heating device.

TECHNICAL FIELD

According to the state of the art, exhaust mufflers for motor vehicles are known in two different application variants.

In one application variant, the exhaust muffler serves to reduce the combustion noise of a motor vehicle internal combustion engine. The exhaust muffler, e.g. an after-muffler, is situated in the exhaust gas line of the internal combustion engine.

In the other application variant of an exhaust muffler of the kind considered here, the exhaust muffler serves to reduce the combustion noise of fuel-operated vehicle supplementary heating devices in the form of booster heaters and standstill heaters. The exhaust muffler is then usually a separate component, i.e., separated from the heating device proper, and is situated in the exhaust pipe of the heating device. Booster heaters and standstill heaters are operated with liquid fuel (diesel or gasoline) and are water heating devices or air heating devices. Booster heaters are heating devices, which contribute, when the motor vehicle engine is operating, to improving the heat output to the vehicle interior and to the engine. Standstill heating devices are heating devices which also make heat output available to the vehicle independently of the engine, particularly when the vehicle is stationary, even when the vehicle engine is not running.

SUMMARY OF THE INVENTION

The invention has as its object to provide an exhaust muffler of the kind mentioned at the beginning, which enriches the state of the art of the said second application variant, particularly by the provision of an exhaust muffler which is of very simple and compact construction and nevertheless effects optimum damping, even in the low frequency region.

This object is attained by an exhaust muffler for a fuel-operated heating device of half-shell construction, comprising upper and lower housing half shells, an exhaust gas through-duct, and absorption and reflection chambers, in which the exhaust muffler is connectable to an exhaust pipe of the heating device, wherein the exhaust gas through-duct comprises an inlet pipe of an absorption chamber, a reflection chamber following the absorption chamber, and an outlet pipe, the inlet pipe comprises a perforated outer surface, an S-shaped curved section and a straight end section, the outlet pipe comprises a straight pipe having an outer surface and an inlet section and is closed on its outer surface, and the straight end section of the inlet pipe runs parallel to, and is spaced from, the inlet section of the outlet pipe.

A development of the invention is a particular construction of an exhaust muffler of the second application variant. The exhaust muffler is characterized by an exhaust gas through-duct, which is constituted by an inlet pipe of a single absorption chamber, a following single reflection chamber, and an outlet pipe. The inlet pipe is perforated on the outer surface side and has a S-shaped curvature section and a straight end section, while the output pipe is straight and is closed, i.e. unperforated, on the outer surface side. The straight end section of the inlet pipe runs parallel to, and at a spacing from, an inlet section of the output pipe. The absorption chamber and the reflection chamber are separated from one another by a vertical partition.

The inlet pipe preferably has an inlet opening, which is situated in coaxial extension of the outlet pipe and is aligned with an outlet opening of the outlet pipe.

The S-shaped curved section of the inlet pipe can be connected directly to the inlet opening of the inlet pipe.

The S-shaped curved section has in particular a straight intermediate section, the longitudinal axis of which forms an angle of preferably 45° to the longitudinal axis of the outlet pipe.

In a particular variant, the outlet pipe is about twice as long as the straight end section of the inlet pipe.

Between the inlet pipe and the outlet pipe there is formed an angled partition which is vertical with respect to the separating plane of the housing half shells of the exhaust muffler, and which extends predominantly transversely through the whole internal space of the exhaust muffler and separates the absorption chamber from the reflection chamber.

The angled partition also extends partially about centrally between the inlet pipe and outlet pipe in the longitudinal direction of the exhaust muffler, i.e., in the direction of the longitudinal axis of the outlet pipe.

In particular, the angled partition bordering on the housing half shells has, in the region of the S-shaped curved section, a first angled end section which extends about parallel to the axis of the curved section, preferably straight and at an angle of 45° to the axis of the outlet pipe; a planar middle section, which extends parallel to the axis of the outlet pipe; and also, in the region of an outlet opening of the inlet pipe, a second angled end section which runs at right angles to the middle section and is drawn over an outer edge of an outlet opening of the inlet pipe.

The middle section and the second angled end section of the partition have perforations, while the first angled end section of the partition forms a closed surface.

At least the inlet pipe can be constructed from two half shells which are connected together in their parting plane by a shell fold.

The housing half shells of the exhaust muffler have preferably stamped shaped creases.

In particular, each housing half shell can have a central shaped crease, which positively supports the outlet pipe on the lower or upper side in the region of its inlet opening.

Shaped creases of the housing half shells can also support the inlet pipe at the end(s), preferably with the interposition of sound-damping material which is arranged in the absorption chamber.

Shaped creases which do not contact the inlet pipe and the outlet pipe can be constituted in the housing half shells.

In a particular form of the invention, the absorption chamber can have at least two compression molded parts of sound damping material, particularly of glass fiber material; the one compression molded part fills a space of the lower housing half shell and, after insertion of the inlet pipe, the other compression molded part fills an upper space of the upper housing half shell.

The inlet opening of the inlet pipe can have an unperforated peripheral edge into which an exhaust pipe of the heating device can be positively inserted positively and sealingly connected.

The outlet opening of the outlet pipe, positively supported and sealed on the peripheral edge of the housing half shells, can be arranged set back within the interior of the exhaust muffler, and the peripheral edge of the housing half shells can be provided with an outer support surface on which an outer end pipe of the exhaust muffler is positively set and which can be connected to the outlet pipe.

Special production advantages result when the upper and lower housing half shells are of like construction.

Like or symmetrically constructed housing half shells and aligned arrangement of the inlet opening of the inlet pipe with respect to the outlet opening of the outlet pipe make possible in particular a simple laterally inverted mounting of the exhaust muffler in an exhaust pipe of the heating device. In this case, the exhaust gas throughflow runs through the exhaust muffler in the reversed direction.

The invention provides an effective construction of an exhaust muffler for a heating device, the known sound damping and silencing and sound insulation mechanisms of absorption, reflection, and interference being advantageously used while maintaining the counter-pressure which is critical for the heating device. This relates in particular to the internal structure of the exhaust muffler. However, the outer surface shells are also shaped favorably from the standpoint of acoustic technology, the formation of resonant members being prevented. The constructional shape of the exhaust muffler is chosen, and preferably ascertained by research, so that operating noises are effectively reduced, and in fact at all the power levels of a heating device which can be operated at several power levels.

Admittedly, there are possibly individual features of the invention which are known in vehicle mufflers of the first application variant mentioned at the beginning, i.e., in exhaust mufflers connected to internal combustion engines. However, the characteristics of the exhaust noise of heating devices differs substantially in its characteristics from the exhaust noise of vehicles. The exhaust noise of heating devices is a wide-band, uniform noise which results from the burning of a flame and the operation of a fan. The exhaust noise of vehicles, on the contrary, is a strongly pulsating noise, which results from the four-stroke operating mode of an internal combustion engine. For this reason, vehicle mufflers and heating device mufflers cannot be compared with each other. Seemingly similar constructional modes of vehicle mufflers thus cannot be consulted for comparison.

The manner of operation of the heating device exhaust muffler is as follows.

The heating device in its operating state develops a noise, which is brought about by the combustion of an air-fuel mixture. The exhaust gas stream is conducted through the exhaust muffler interpolated in the exhaust gas line of the heating device. The acoustic energy is hereby partially eliminated. The exhaust gas enters the exhaust muffler and is conducted in a perforated pipe, namely the inlet pipe. The perforated pipe is situated in an absorption chamber, i.e., it is surrounded on all sides with a sound-absorbing material. At the outlet of the perforated pipe, the gas enters a reflection chamber. An abrupt change in cross section occurs here. In the reflection chamber, the exhaust gas is deflected oppositely to its original flow direction and reaches the inlet of a closed pipe, namely the outlet pipe, which has a minimum excess length, i.e., at least one pipe section, parallel at the same axial height of the perforated pipe. The exhaust gas stream thus comes out of the reflection chamber into the closed pipe, and is finally conducted out of the exhaust muffler. The absorption and reflection chambers are separated from each other by a partition. The outer surface shells are embodied with a convex curvature. They include shaped creases, among other things. The throughflow direction of the exhaust muffler can also be reversed.

BRIEF DESCRIPTION OF THE DRAWINGS

The invention is described in detail hereinbelow using embodiments, with reference to the accompanying drawing.

DETAILED DESCRIPTION OF THE INVENTION

Figure 1:
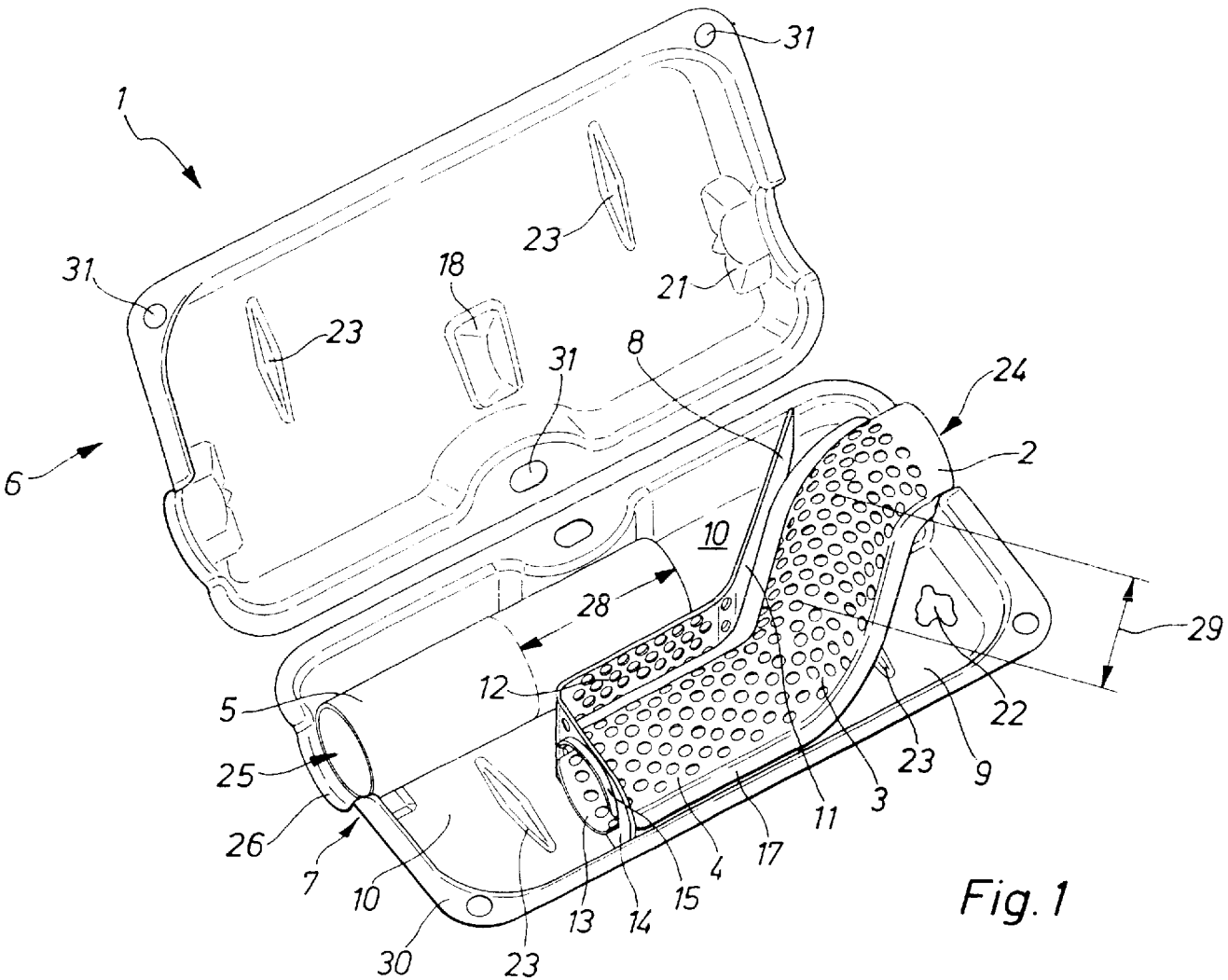
FIG. 1 shows an exhaust muffler for a fuel-operated heating device of two-chamber construction in half shell technology, schematically in a first perspective view with the upper housing half shell folded up.

An exhaust muffler 1 for a fuel operated heating device (not shown) in the form of a standstill heating device of a fuel-operated motor vehicle is shown in the drawing. The exhaust muffler 1 is connected by its inlet opening 24 to an exhaust pipe (not shown) of the standstill heating device. A further end pipe (not shown) is connected to the outlet opening 25, and has an opening on the outlet side in the direction of the atmosphere.

The exhaust muffler 1, of half shell construction, has an upper housing half shell 6 and a lower housing half shell 7, which are secured together in their horizontal separation plane by means of a peripheral fold 30; however, they are shown opened in the drawing. The exhaust muffler 1 is fastened and suspended at a suitable place on the motor vehicle by means of screw connections at three bores 31 in the peripheral fold 30.

The exhaust muffler 1 includes an internal exhaust gas through-duct, which is formed by an inlet pipe 2 of a single absorption chamber 9, a following single reflection chamber 10, and an outlet pipe 5.

The inlet pipe 2 has perforations 16 on the outer surface side. The inlet pipe 2 has an S-shaped curved section 3 on its inlet side near its inlet opening 24 and a straight end section 4 on its outlet side.

The outlet pipe 5 is a straight outlet pipe, closed at its outer surface.

The straight end section 4 of the inlet pipe 2 runs parallel to, and at a spacing from, an inlet section 28 of the outlet pipe 5. The exhaust muffler thus has, seen in the axial exhaust gas flow direction, a double pipe construction in its middle region, while a curved single pipe in its inlet region and a straight single pipe in its outlet section are provided.

The input pipe 2 has an inlet opening 24 which runs in coaxial extension of the output pipe 5 and is aligned with an outlet opening 25 of the outlet pipe.

Both housing half shells 6, 7 are of like constitution.

The S-shaped curved section 3 of the input pipe 2 is directly connected to the inlet opening 24 of the inlet pipe.

The S-shaped curved section 3 has a straight intermediate section 29, the longitudinal axis of which is at an angle of 45° to the longitudinal axis of the outlet pipe 5 or to the straight section 4 of the input pipe 2.

The output pipe 5 is about twice as long as the straight section 4 of the inlet pipe 2.

An angled partition 8, vertical with respect to the separating plane of the housing half shells 6, 7 of the exhaust muffler 1, is situated between the inlet pipe 2 and the outlet pipe 5, extends substantially transversely through the whole internal space of the exhaust muffler, and separates the absorption chamber 9 from the reflection chamber 10.

The angled partition 8 also partially extends in the longitudinal direction to about centrally between the inlet pipe 2 and the outlet pipe 5.

The angled partition 8 borders on the housing half shells 6, 7 and has a first angled end section 11, a middle section 12 and a second angled end section 14.

The first angled end section 11 is unperforated and planar and is situated about parallel to the axis of a straight intermediate section 29 of the curved section 3. The first angled end section 11 forms an angle of 45° to the axis of the outlet pipe 5.

The middle section 12 is likewise planar and runs parallel to the axis of the outlet pipe 5 and also parallel to the axis of the straight end section 4 of the inlet pipe 2. It can also be said that the partition 8 runs axially parallel to the inlet pipe 2 in a large region.

The second angled end section 14 of the angled partition 8 extends at right angles to the middle section 12 and is drawn over an outer edge 15 of an outlet opening 13 of the outlet pipe 2.

The middle section 12 and the second angled end section 14 of the partition 8 have perforations 27, while the first angled end section 11 of the partition 8, as already mentioned, forms a closed surface.

While the outlet pipe 5 is an integral closed pipe, the inlet pipe 2 is constructed of two half shells or of two pipe halves, which are secured together in their midplane with a shell fold 17.

The housing half shells 6, 7 of the exhaust muffler have stamped, shaped creases which provide for the stiffening of the housing half shells and also contribute to preventing or damping vibrations. The diverse shaped creases also act as an abutment surface for the inlet pipe 2 and the outlet pipe 5.

Thus each housing half shell 6 or 7 has a central shaped crease 18, which positively supports the outlet pipe 5 on the lower or upper side in the region of its inlet opening 19.

According to the variant embodiment according to FIG. 1, a shaped crease 21 of the upper and the lower housing half shell supports the inlet opening 24 of the inlet pipe 2, while on the other side the outlet opening 13 of the inlet pipe 2 is held by the drawn-over partition 8. In addition, the surrounding absorption material has a supportive effect.

Figure 2:
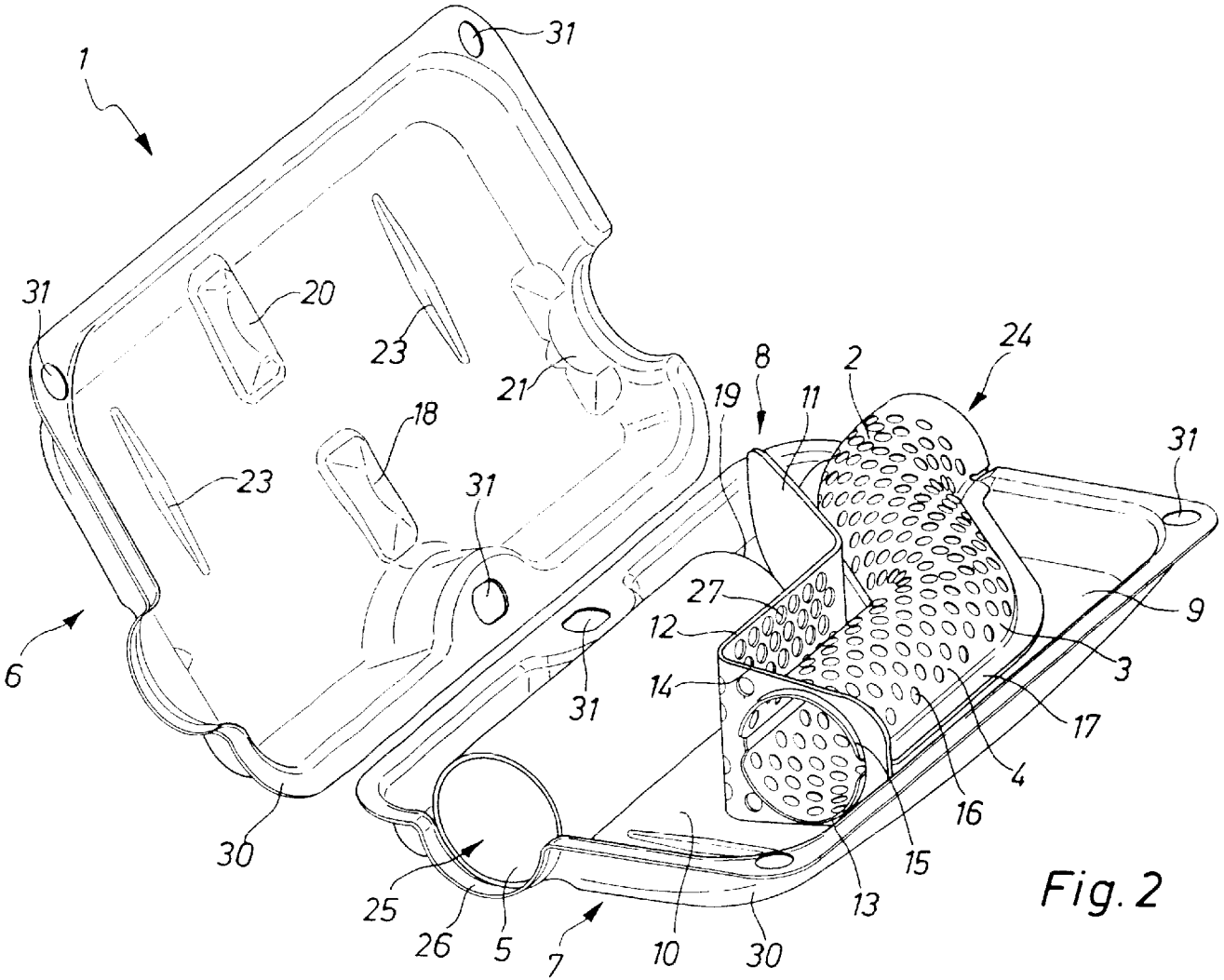
FIG. 2 shows the exhaust muffler basically as in FIG. 1, schematically in a second perspective view, but with further shaped creases.

According to the variant embodiment according to FIG. 2, two shaped creases 20, 21 of the housing half shells support both the inlet opening 24 and also the outlet opening 13 of the inlet pipe 2, and in fact with the interposition of sound absorbing material 22 which is arranged in the absorption chamber 9.

Furthermore, shaped creases 23 which are free from contact with pipes are constituted in the housing half shells and are of particular importance for noise reduction, precisely in the region of the reflection chamber 10. They prevent a vibrational excitation of the housing half shells 6, 7.

The absorption chamber 9 has two compression molded portions, not shown in detail, of sound absorbing material 22, particularly of glass fiber material, the one compression molded portion filling a space of the lower housing half shell 7 and, after insertion of the inlet pipe 2, the other compression molded portion fills an upper space of the upper housing half shell 6.

The inlet opening 24 of the inlet pipe 2 includes an unperforated peripheral edge, into which the already mentioned exhaust pipe of the heating device can be positively inserted and sealingly connected.

On the outlet side of the exhaust muffler 1, the outlet opening 25 of the outlet pipe 5, positively supported and sealed on the peripheral edge of the housing half shells 6, 7, is arranged and in the interior of the exhaust muffler. The peripheral edge of the housing half shells has an outer support surface 26 there, on which an outer end pipe of the exhaust muffler is positively set and which can be connected to the outlet pipe 5.

The exhaust muffler 1 of two-chamber construction described hereinabove is clearly very compact and constructed from few individual parts which can be easily mass-produced and are also easy to assemble. With the individual parts manufactured, the lower compression molded portion of sound absorbing material 22 is positively inserted into the lower housing half shell 7 in the region of the absorption chamber 9, and then the unit, previously joined together, of angled partition 8 and inlet pipe 2, in which the second angled end section 14 is drawn over the outer edge 15 of the straight section 4 of the inlet pipe 2, is placed into the lower housing half shell 7 and spot welded at the end. The upper compression molded part of sound absorbing material 22 is then inserted into the absorption chamber 9. Also, the outlet pipe 5 is placed on the fitting abutments of the central shaped crease 18 of the lower housing half shell 7 and spot welded in the region of the outlet opening 25. Finally, the upper housing half shell 6 is set exactly fitting on the lower housing half shell 7 equipped with the inner portions of the muffler, and the peripheral fold 30 is formed with a special folding tool. An exhaust muffler produced in this manner can then easily be end-mounted in the straight exhaust pipe of the heating device, and if necessary retrofitted to a heating device.

In the operation of an end-mounted exhaust muffler 1, the exhaust gas of the heating device enters the absorption chamber 9, which is completely filled on the outer side with sound absorbing material 22, through the inlet opening 24 of the perforated inlet pipe 2, sound energy being eliminated by the sound absorbing material 22, not only by means of the perforation 16, but also specially by means of the perforation 27 of the angled partition 8. After passage of the exhaust gas through the outlet opening 13 of the inlet pipe 2, the exhaust gas reaches the following reflection chamber 10. The exhaust gas is deflected through 180° there by the end of the exhaust muffler 1 and conducted back as a countercurrent into the empty space between the partition 8 and the outlet pipe 5, and is also reflected at all obstructions, such as the outer wall of the outlet pipe 5 and the housing half shells 6, 7. A further elimination of sound takes place in the region of the perforated middle section 12 of the partition. A further large part of the sound energy is extinguished by the reflection of the sound waves in the reflection chamber 10. After the reflection chamber 10, the exhaust gas finally enters the straight outlet pipe 5 through the inlet opening 19 with an abrupt change of cross section, and from there through the outlet opening 25 into the end pipe or into the atmosphere, in a silenced, steady flow.

What is claimed is:

1. An exhaust muffler for a fuel-operated heating device of half-shell construction comprising:

upper and lower housing half shells 6, 7, an exhaust gas through-duct, and absorption and reflection chambers 9, 10, in which the exhaust muffler is connectable to an exhaust pipe of the heating device, wherein the exhaust gas through-duct comprises an inlet pipe 2 of the absorption chamber 9, the reflection chamber 10 following the absorption chamber, and an outlet pipe separate from the inlet pipe, the inlet pipe 2 comprises a perforated outer surface, an S-shaped curved section 3 and a straight end section 4, the outlet pipe comprises a straight pipe 28 having an outer surface and an inlet section and is closed on its outer surface, and the straight end section 4 of the inlet pipe runs parallel to, and is spaced from, the inlet section of the outlet pipe, inlet pipe has an outlet opening and the outlet pipe has an inlet pipe, the outlet opening of the inlet ripe being spaced from the inlet opening of the outlet pipe.

2. The exhaust muffler according to claim 1, wherein the absorption chamber comprises a single absorption chamber, and the reflection chamber comprises a single reflection chamber.

3. The exhaust muffler according to claim 2, wherein the the inlet pipe has an inlet opening which in coaxial extension of the outlet pipe is aligned with the outlet opening of the outlet pipe.

4. The exhaust muffler according to claim 3, wherein the S-shaped curved section of the inlet pipe connects directly to the inlet opening of the inlet pipe.

5. The exhaust muffler according to claim 2, wherein the S-shaped curved section of the inlet pipe comprises a straight intermediate section whose longitudinal axis forms an angle to the longitudinal axis of the outlet pipe.

6. The exhaust muffler according to claim 5, wherein the longitudinal axis of the straight intermediate section forma an angle of 45° to the longitudinal axis of the outlet pipe.

7. The exhaust muffler according to claim 1, wherein the outlet pipe is about twice as long as the straight end section of the inlet pipe.

8. The exhaust muffler according to claim 2, further comprising an angled partition that is vertical with respect to a separating plane of the housing half shells, located between the inlet pipe and the outlet pipe, and extending substantially transversely through the whole internal space of the exhaust muffler, which angled partition separates the absorption chamber from the reflection chamber.

9. The exhaust muffler according to claim 8, wherein the angled partition partially extends longitudinally and about centrally between the inlet pipe and the outlet pipe.

10. The exhaust muffler according to claim 9, wherein the angled partition, bordering on the housing half shell, comprises a first angled end section in the region of the S-shaped curved section of the inlet pipe, extending about parallel to the axis of the curved section, at an angle of about 45° to the axis of the outlet pipe; a planar middle section which extends parallel to the axis of the outlet pipe; and a second angled end section in the region of an outlet opening of the inlet pipe, running at right angles to the middle section and drawn over an outer edge of the outlet opening of the inlet pipe.

11. The exhaust muffler according to claim 10, wherein the middle section and the second, angled end section of the partition have perforations, and the first angled end section of the partition comprises a closed surface.

12. The exhaust muffler according to claim 2, wherein at least the inlet pipe comprises two half shells which are connected together at a separating plane with a shell fold.

13. The exhaust muffler according to claim 2, wherein the housing half shells comprise stamped-in shaped creases.

14. The exhaust muffler according to claim 13, wherein each housing half shell comprises a central shaped crease that positively supports the outlet pipe on the lower or upper side in the region of its inlet opening.

15. The exhaust muffler according to claim 13, wherein the housing half shells comprise shaped creases that support the inlet pipe.

16. The exhaust muffler according to claim 15, further comprising sound absorbing material arranged in the absorption chamber.

17. The exhaust muffler according to claim 13, further comprising shaped creases that do not contact the inlet and outlet pipes formed in the housing half shells.

18. The exhaust muffler according to claim 2, wherein the absorption chamber comprises at least two compression molded parts of sound absorbing material, one compression molded part filling a space in the lower housing half shell and the other compression molded part filling an upper space of the upper housing half shell after insertion of the inlet pipe.

19. The exhaust muffler according to claim 18, wherein the sound absorbing material comprises glass fiber material.

20. The exhaust muffler according to claim 2, wherein the inlet pipe comprises an inlet opening having an unperformed peripheral edge into which the exhaust gas pipe of the heating device is positively inserted and sealingly connected.

21. The exhaust muffler according to claim 3, wherein the outlet opening of thc outlet pipe is positively supported and sealed at a peripheral edge of the housing half shells, and is arranged set back in the interior of the exhaust muffler, the peripheral edge of the housing half shells comprising an outer support surface on which an outer end pipe of the exhaust muffler is positively set and sealingly connected to the outlet pipe.

22. The exhaust muffler according to claim 2, wherein the upper and the lower housing half shells are of like constitution.

23. The exhaust muffler according to claim 2, wherein the flow direction of the exhaust muffler is reversed.

* * * * *